United States Patent [19]

Hodsden et al.

[11] 3,938,214

[45] Feb. 17, 1976

[54] CASCADE RINSING SYSTEM AND METHOD

[75] Inventors: John B. Hodsden, Crown Point; James V. Middleton, Highland; Edmund W. James, Crown Point, all of Ind.

[73] Assignee: Inland Steel Company, Chicago, Ill.

[22] Filed: Jan. 14, 1974

[21] Appl. No.: 431,304

[52] U.S. Cl. ..... 15/102; 134/60; 134/64 R

[51] Int. Cl.[2] ..... A47L 25/00

[58] Field of Search ..... 15/77, 102; 134/60, 64, 134/9, 15, 122

[56] References Cited

UNITED STATES PATENTS

| | | | |
|---|---|---|---|
| 1,544,506 | 6/1925 | Tytus | 134/64 |
| 1,817,332 | 8/1931 | Worrall | 15/77 |
| 2,264,885 | 12/1941 | Mueller | 15/77 X |
| 2,282,628 | 5/1942 | Whann et al. | 15/77 X |
| 2,949,120 | 8/1960 | Federighi et al. | 134/60 X |
| 3,082,774 | 3/1963 | Benton et al. | 15/102 X |

FOREIGN PATENTS OR APPLICATIONS

| | | | |
|---|---|---|---|
| 914,832 | 7/1946 | France | 134/60 |
| 1,386,199 | 12/1964 | France | 134/60 |

*Primary Examiner*—Edward L. Roberts

*Attorney, Agent, or Firm*—Merriam, Marshall, Shapiro & Klose

[57] ABSTRACT

A rinsing system for steel strip after acid pickling comprises a plurality of consecutive adjacent rinse compartments, each of which contains a bath of rinse solution which is sprayed onto the strip as it passes through the compartment. Fresh water is added to the last compartment and a volume of solution equivalent to the added fresh water is continuously transferred from each compartment to an adjacent compartment. A concentrated waste rinse effluent is removed from the first compartment.

10 Claims, 3 Drawing Figures

CASCADE RINSING SYSTEM AND METHOD

This invention relates to a cascade rinsing system and method for continuously rinsing steel strip after a pickling operation.

During the continuous treatment of steel strip in a steel plant, it is conventional to subject the strip to a pickling operation in which an acid bath is used to remove surface contaminants, such as rust and other foreign substances. On emerging from the pickling operation, the surface of the steel strip is covered with an adherent film of the acid bath used in the pickling operation. This liquid film, containing dissolved iron salts and residual acid, must be removed before continued processing of the strip can proceed.

The conventional method for removal of the film of acid solution from the strip involves passing the strip through a rinse system consisting of two tanks. In the first tank, the strip is sprayed with hot or cold water for removal of a portion of the adhering acid solution. After leaving the first tank, the strip enters the second tank, in which it is immersed or dunked in a pool of water which dilutes the adhering liquid film on the strip sufficiently to reduce the concentrations of iron salts and acid therein to an acceptably low level. In order to achieve the necessary dilution, however, it is required that the second or dunk tank must contain a volume of water which is very large in relation to the volume of liquid adhering to the metal strip entering the bath. In addition to the cost of the fresh water which is used in this system, the disposal of the large volume of discolored and acid-contaminated rinsing solution presents a serious problem.

These problems are overcome by the present invention, which employs a cascade system for rinsing the pickled strip. The system of the invention comprises a plurality of separate consecutive compartments, each of which contains a bath of rinse solution which is pumped from the compartment and sprayed onto the strip as it passes through the compartment over a bath of rinse solution contained therein. The solution is immediately wrung off the strip into the compartment from which it came, by a suitable wringing system. Fresh water is added continuously to the last compartment in the direction of strip travel and a volume of solution equivalent to the added fresh water is continuously transferred from each compartment to the immediately upstream (relative to strip travel) compartment, thereby maintaining a constant volume in each of the compartments.

As a result of the cascade effect of the fresh water addition, each compartment contains less dissolved iron salts and residual acid than the adjacent upstream compartment. The dissolved iron and acid contents of the bath in the first compartment (i.e., the compartment into which the strip first enters the cascade system) become quite concentrated, whereas the concentration of iron and acid in the last compartment, where the fresh water is added, stays at an acceptably low level.

The system of the invention allows the strip to be flushed in each compartment with large amounts of rinse solution for effective rinsing, but results in the production of only small volumes of waste effluent, which although containing high acid and iron salt concentrations, can be readily disposed of. In addition, the net consumption of fresh water is very low, thus effecting a significant economy in the cost of the rinsing operation.

The invention will be better understood from the following detailed description thereof, taken in conjunction with the accompanying drawings, in which.

Figure 1:
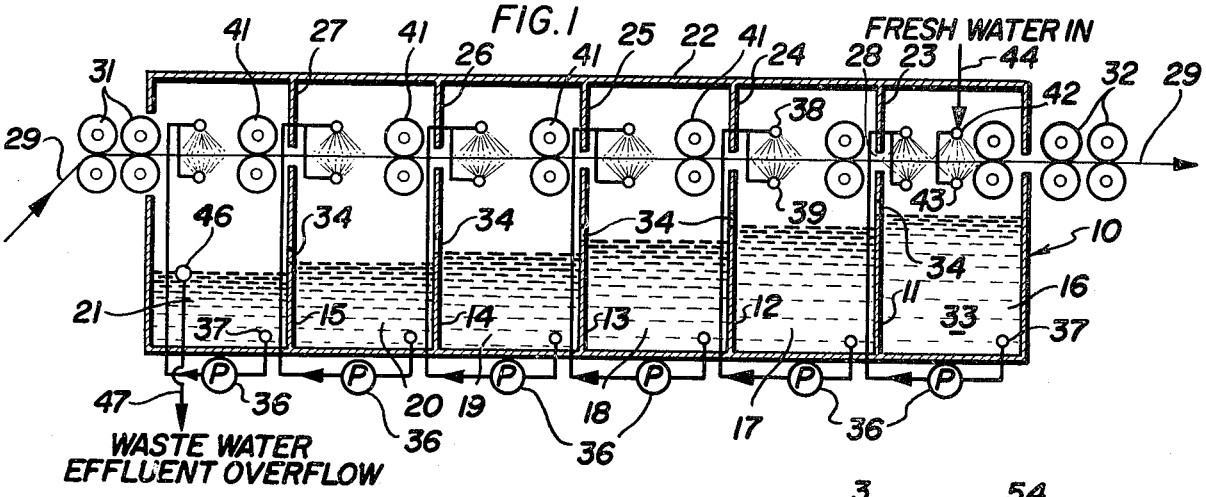
FIG. 1 is a side sectional view of a typical embodiment of the invention.

As shown in FIG. 1, in a typical embodiment the invention comprises a rinse tank 10 which is separated by vertical partitions 11–15 into a plurality of adjacent rinse compartments 16–21. The tank is provided with a cover 22 which is also equipped with vertical partitions 23–27 corresponding to partitions 11–15. The partitions in the rinse tank 10 and the corresponding partitions in the cover 22 (e.g., 11 and 23) define slits (e.g., 28) through which the strip 29 to be rinsed passes.

Strip 29, leaving a pickling operation (not shown), enters the rinse tank at the left side of FIG. 1 and is transported through the tank by means of idler roll 31 and driven rolls 32.

Each compartment, e.g., 16, is water tight and contains a bath, e.g., 33, of rinse solution. Since in operation of the rinsing system, the rinse solutions become contaminated with acid, the material used to form the tank and the partitions, or at least the surfaces thereof, is suitably one which is resistant to the action of acid. Each partition in the tank, e.g., 11, is provided with a weir 34, typically a hole of appropriate size, at an elevation which increases from the first (15) to the last (11) partition within the rinse tank. Accordingly, any excess which temporarily accumulates within any compartment flows rapidly through the weir to the adjacent compartment.

Figure 2:
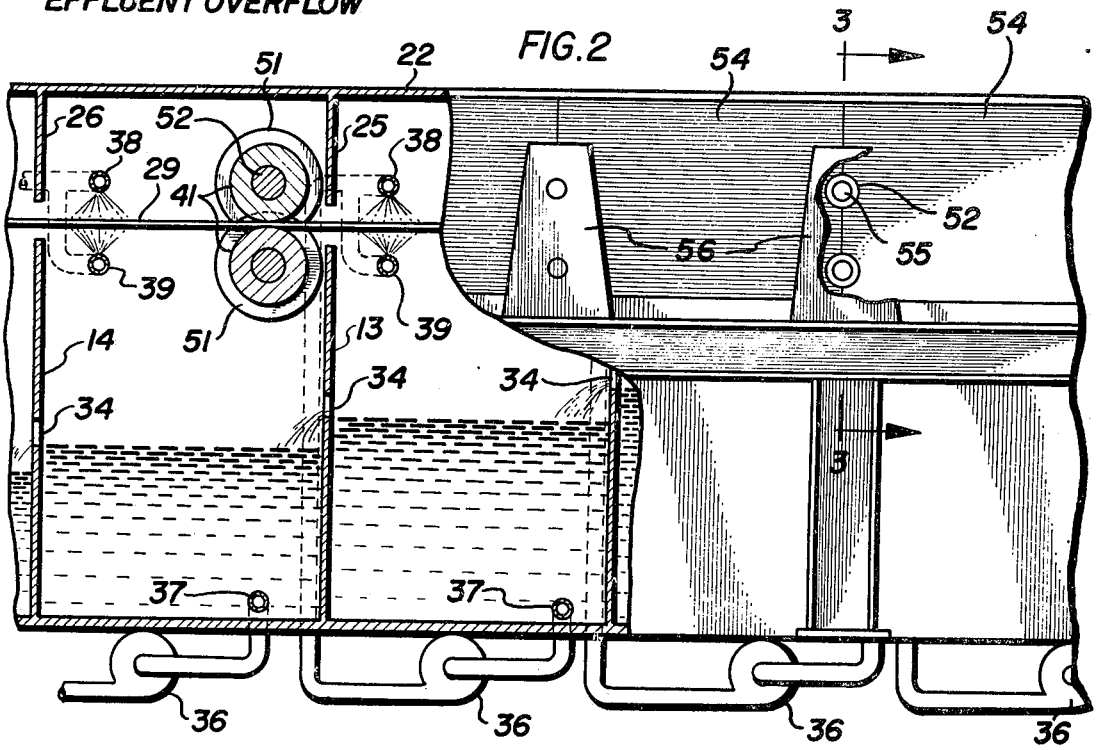
FIG. 2 is an enlarged view in partial section of a portion of the system of FIG. 1.

Each of compartments 16–21 is provided with a pump 36 which draws the rinse solution contained within the compartment through an intake 37 and supplies it to a spray system consisting of two spray heads 38 and 39 (FIG. 2), one located above and one located below the strip 29 passing therethrough. Spray heads 38 and 39 are directed against the surfaces of the strip and discharge the rinse solution with sufficient force to dislodge the liquid film adhering to the strip as it enters the compartment and to replace it with a film having the same composition as the rinse solution within the associated compartment. Before leaving a compartment, strip 29 passes through undriven wringer rolls 41 which remove as much as possible of the adhering liquid film and cause it to drop into the compartment below.

The last compartment 16 in the direction of strip travel, i.e., at the right end of FIG. 1, is provided with an additional spray system similar to that contained within each of the other compartments. This spray system, comprising spray heads 42 and 43, is fed with fresh water through line 44 which further reduces the concentration of contaminants in the liquid film adhering to the surfaces of the strip to the desired level. On leaving the rinse tank 10, strip 29 is passed to further processing steps in accordance with conventional practice.

It will be seen that the addition of fresh water tends to cause the level of solution in compartment 16 to rise until it starts overflowing through its associated weir 34 into adjoining compartment 17, thus causing the level within that compartment to tend to rise, until it over-flows through its weir into the adjoining compartment, and so on. Accordingly, there is produced a continuous net transfer of solution from compartment 16 to compartment 21 in a direction opposite to that of strip travel. In compartment 21, an overflow take-off 46 removes the excess solution from the compartment and transfers it through line 47 to a suitable waste disposal system.

During operation of the system, with a constant strip speed and a fixed fresh water addition rate, the concentration of contaminants (i.e., dissolved iron salts and residual acid) in each compartment will tend to reach an equilibrium value which depends in part on the total number of compartments. Although the necessary rate of fresh water addition can generally be decreased as the number of compartments increases, for most practical purposes we have found that a maximum of eight compartments will generally produce good rinsing results and that at least about four such compartments will be necessary for satisfactory rinsing. Further, in order to achieve effective rinsing within each compartment and to insure that the solution in each compartment is adequately mixed it is desirable that the rinsing solution contained within each compartment be recirculated by means of the pump through the spray heads in the associated compartment at a relatively rapid rate. The rinsing action of the spray system in each compartment is both a blasting and a dilution process. Sufficient wash volume is necessary to dilute the solution carried in on the strip and the pressure of the spray should be high enough to break the film of solution on the strip. It will be found generally satisfactory if the recirculating pumps 36 have a capacity sufficient to recirculate the contents of the compartment every three to eight minutes. Thus, for example, a recirculation pump having a capacity of 200 gallons per minute will be found satisfactory for a compartment containing about 600–1,600 gallons. The relatively high recirculation capacity of the pumps will also insure that the contents of the tank remain thoroughly mixed so that the spray which is applied to the incoming strip is representative of the main body of the rinse solution contained within the compartment.

As previously noted, the necessary quantity of fresh water added to the last compartment is dependent to a certain extent on the number of compartments within the system. Using the preferred number of compartments of four to eight, it will be found generally satisfactory if the ratio of recirculation, i.e., the rate at which wash water is sprayed on the strip in each compartment, to the throughput, i.e., the rate of addition of fresh water, and assuming no losses in the system, the rate at which solution is transferred between compartments through the weirs, is within the range of about 3 to 20, the lower value being useful in a four tank system and the upper ratio being satisfactory for an eight tank system. For a preferred embodiment in which the system comprises six tanks, the recirculation/throughput rate is suitably 8 to 10.

In order to achieve the advantages of the system, it is necessary to restrict as much as possible the transfer of solution from one compartment to another, except directly through the weirs. This result is achieved by using rolls which are designed and sized so as to achieve a maximum removal of adherent water from the strip leaving one compartment before it enters the adjoining compartment. In addition, in order to prevent transfer of the spray within one compartment to the adjoining compartment the slit, e.g., 28, formed by the vertical partitions, e.g., 11 and 28 should be as narrow as possible.

Figure 3:
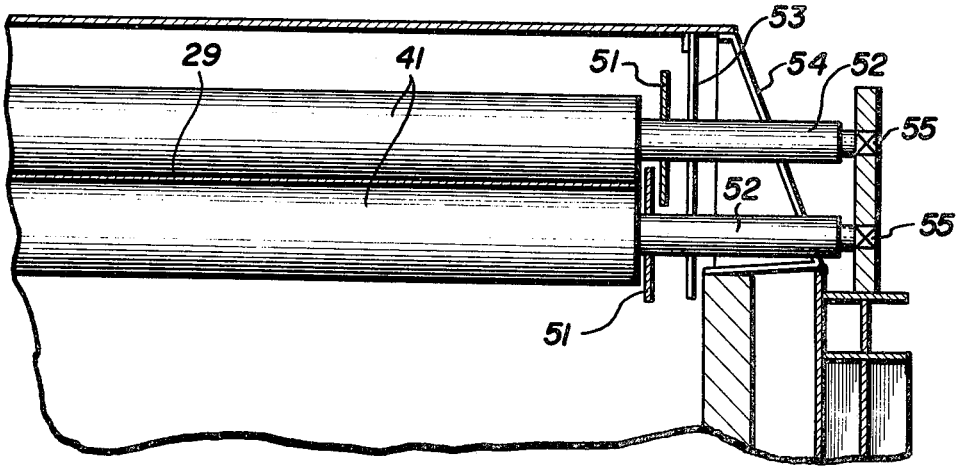
FIG. 3 is a view along the line 3–3 of FIG. 2.

Since the solutions contained within the several compartments are acidic, it is desirable to prevent leakage of the rinsing solutions, in order to avoid maintenance problems in the vicinity of the rinsing system. In order to minimize such leakage in the vicinity of the roll neck openings in the sides of the rinse tank, an area where such leakage is particularly likely to occur, there can be used the baffle system shown in FIG. 3. As shown, the system comprises a pair of staggered slingers 51, i.e., circular plates of acid-resistant material, which are fastened on the roll necks 52. The slingers serve to intercept the passage of spray tending to leave the side of the rinse tank. The baffle system also uses a flexible curtain 53 which is slitted and provided with suitable openings for the roll necks. As a further barrier there can also be used a sliding splash box cover 54 provided with openings through which the roll necks pass, the ends of which are contained within bearings 55 supported in roll stands 56.

As an example of the efficiency of the rinsing system of the invention in reducing the quantity of rinse water which must be used, and accordingly the quantity of waste acid effluent which must be disposed of, there will be described a typical installation made in accordance with the invention. The installation was used in a conjunction with a continuous strip pickling line treating a strip 60 inches wide traveling at the rate of about 800 feet per minute. Using a conventional two tank dunk system, it was necessary to use about 500 gallons per minute of fresh water in order to reduce the dissolved iron content in the dunk tank, and hence the concentration in the rinse water adhering to the strip leaving the tank, to an acceptible range of about 20–50 ppm of iron.

The conventional dunk and rinse system was replaced in accordance with the invention with a six-compartment rinsing system, each compartment containing about 650 gallons and provided with recirculation pumps having a pumping capacity of 200 gallons per minute, at a spray pressure of about 50 psi. With the system as described, it was possible to reduce the waste rinse water effluent to 25 gallons per minute, a 95% reduction, while maintaining the same rinsing efficiency. Not only was there a substantial savings achieved through the use of much less water, but more significantly, the much smaller volume of waste effluent, which although considerably more concentrated than that of the previous treatment, could be readily disposed of, as by injection in a deep well or by neutralization with lime. Further, since the waste effluent was relatively concentrated in chloride content, it could be fed to a acid regeneration plant for regeneration of the spent acid.

The foregoing detailed description has been given for clearness of understanding only, and no unnecessary limitations should be understood therefrom, as modifications will be obvious to those skilled in the art.

We claim:

1. A cascade rinsing system for rinsing a continuously moving steel strip following a pickling operation or the like, said system comprising;

a plurality of rinse compartments arranged consecutively in the direction of travel of said strip, each compartment being adapted to contain a bath of aqueous rinse solution;

spray means located above the bath in each compartment for spraying the surfaces of strip passing therethrough;

means for continuously supplying rinse solution from the bath contained in each compartment to the spray means associated with said compartment for use in spraying said strip;

wringing means in each compartment for removing excess rinse solution from the surfaces of the strip after it has been sprayed;

means for continuously adding fresh wash water to the last of said compartments in the direction of strip travel;

means for continuously conveying rinse solution from each compartment to the adjacent compartment in the upstream direction of strip travel; and means for removing waste rinse effluent from the first of said compartments.

2. The system of claim 1 wherein each said compartment is provided with means for maintaining a constant bath volume therein.

3. The system of claim 2 wherein adjacent compartments are contiguous and said constant-volume maintaining means comprises an overflow weir located between adjacent compartments.

4. The system of claim 3 in which said weirs are located at elevations which increase from the first to the last of said compartments, whereby a flow of rinse solution from one compartment to an adjacent compartment occurs under the influence of gravity.

5. The system of claim 1 wherein said fresh water supply means includes a second spray means in said last compartment for spraying said strip after it has been sprayed with the bath contained therein.

6. The system of claim 1 wherein said wringing means comprises wringer rolls.

7. The system of claim 1 which contains about 4 to 8 compartments.

8. The system of claim 1 which is additionally provided with baffle means along the path of travel of said strip between adjacent compartments for impeding the transfer of rinse spray between adjacent compartments.

9. A cascade rinsing system for rinsing continuously moving steel strip following a pickling operation or the like, said system comprising:

a plurality of contiguous rinse compartments arranged consecutively in the direction of travel of said strip, adjacent compartments being separated by a common wall, each compartment being adapted to contain a bath of aqueous rinse solution;

spray means located above the bath in each compartment for spraying both sides of strip passing therethrough;

means for continuously conveying a supply of rinse solution from the bath contained in each compartment to the spray means associated with said compartment for use in spraying said strip;

wringing means in each compartment for removing excess rinse solution from the surfaces of the strip after it has been sprayed;

baffle means between adjacent compartments for impeding the transfer of rinsing solution spray therebetween;

fresh water supply means located in the last compartment including spray means for spraying the strip passing therethrough with fresh water after it has been sprayed with the rinse solution in said compartment;

weir means located in each of said common walls for maintaining a constant bath level in the associated compartment, the elevations of said weirs increasing from the first to the last of said compartments, whereby a flow of rinse solution corresponding to the fresh water addition occurs from the last to the first of said compartments under the influence of gravity; and means for removing waste rinse effluent from the first of said compartments.

10. The system of claim 9 which includes about 4 to 8 compartments.

* * * * *